US006196142B1

(12) United States Patent
Ohlsen

(10) Patent No.: US 6,196,142 B1
(45) Date of Patent: Mar. 6, 2001

(54) METHOD AND BURNER FOR INTRODUCING FUEL TO A KILN

(75) Inventor: Ib Ohlsen, Copenhagen (DK)

(73) Assignee: F. L. Smidth & Co., A/S (DK)

( * ) Notice: Subject to any disclaimer, the term of this patent is extended or adjusted under 35 U.S.C. 154(b) by 0 days.

(21) Appl. No.: 09/346,518

(22) Filed: Jul. 1, 1999

Related U.S. Application Data

(63) Continuation of application No. PCT/EP98/00145, filed on Jan. 13, 1998.

(30) Foreign Application Priority Data

Mar. 7, 1997 (DK) ..... 0244/97

(51) Int. Cl.[7] ..... F23C 1/10; F23C 1/12

(52) U.S. Cl. ..... 110/264; 110/261; 110/262; 431/183; 431/188

(58) Field of Search ..... 110/260, 261, 110/262, 263, 264, 265; 431/186, 187, 188, 182, 183, 184, 9

(56) References Cited

U.S. PATENT DOCUMENTS

| | | | | |
|---|---|---|---|---|
| 4,422,389 | * | 12/1983 | Schroder | 110/264 |
| 4,428,727 | * | 1/1984 | Deussner et al. | 431/182 |
| 4,718,359 | * | 1/1988 | Skoog | 110/264 |
| 4,726,760 | | 2/1988 | Skoog . | |
| 4,807,541 | * | 2/1989 | Masai et al. | 110/262 |
| 5,199,355 | * | 4/1993 | Larue | 110/261 |
| 5,451,160 | * | 9/1995 | Becker | 431/284 |
| 5,511,375 | * | 4/1996 | Joshi et al. | 60/39.463 |
| 5,697,306 | * | 12/1997 | Larue et al. | 110/261 |

FOREIGN PATENT DOCUMENTS 2070761 9/1981 (GB) .

* cited by examiner

*Primary Examiner*—Denise L. Ferensic
*Assistant Examiner*—Ken Rinehart
(74) *Attorney, Agent, or Firm*—Baker Botts L.L.P.

(57) ABSTRACT

A method and apparatus for introducing solid, liquid or gaseous fuel into a burning zone of a rotary kiln for manufacturing cement clinker. Fuel is conducted through a duct or ducts and primary air is conducted through at least two annular ducts arranged substantially concentrically with, and around, the fuel duct(s), the portion of air in one of the air ducts flowing substantially axially, whereas the portion of air in the second of the air ducts comprises air which has a rotary component about the center axis of the burner, and wherein the amount of primary air in the two portions is independently controlled, such that the two portions of primary air are mixed at a lower velocity in a collecting duct into a single primary mixed airstream having a desired axial/rotary flow characteristic, and wherein this airstream is subsequently accelerated up to a desired, higher discharge velocity.

16 Claims, 3 Drawing Sheets

METHOD AND BURNER FOR INTRODUCING FUEL TO A KILN

This is a continuation of copending International Application No. PCT/EP98/00145 filed Jan. 13, 1998.

BACKGROUND OF THE INVENTION

The present invention relates to a method (hereinafter referred to as of the kind described) for introducing solid, liquid or gaseous fuel into a burning zone of a kiln, such as a rotary kiln for manufacturing cement clinker or similar products, by which method fuel is conducted through a duct or ducts and primary air is conducted through at least two annular ducts arranged substantially concentrically with, and around, the fuel duct(s) , the portion of air in one of the air ducts flowing substantially axially, whereas the portion of air in the second of the air ducts comprises air which has a rotary component about the centre axis of the burner, and the amount of primary air in the two portions being independently controlled. The invention also relates to a burner for carrying out the method according to the invention.

Burners for this purpose are well-known. Originally, they merely consisted of one single pipe through which a mixture of pulverized coal meal and air was injected into the burning zone of the kiln. Over time, design improvements of the burners were implemented, with the incorporation of features such as additional ducts for introducing other types of liquid or gaseous fuel. Furthermore, most modern burners comprise one or several separate ducts for injection of air, so that only a small amount of the primary air is injected together with the pulverized coal. By imparting a rotary motion to some of the injected air it has, to a larger extent, been possible to control the flame shape in the kiln.

An example of a burner of the above mentioned kind is described in EP-B-0421903. This known burner comprises one or several ducts for introduction of fuel, being surrounded by two annular ducts for injecting primary air. In the annular nozzle opening of the innermost of these air ducts are provided oblique blades which impart a rotary motion to the air. In the outermost duct the air is conducted and injected in a substantially axial direction. An adjustment of the nozzle area of both ducts can be made by adjusting the ducts axially relative to one another, and the portions of primary air in the two ducts can also be independently controlled. Variability of flame shape is, therefore, possible with this burner given the possibility of adjusting the flow rate and velocity of the primary air as well as the amount of primary air which is subjected to rotation. However, the drawback of this burner is that the primary air is injected through two separate annular nozzles, resulting in a relatively high pressure loss and a less effective mixing of the primary air with the fuel in the burning zone.

A second example of a burner of the above mentioned kind is described in EP-A-0650012. This known burner also comprises one or several ducts for the introduction of fuel, surrounded by one single primary air duct which discharges into an annular nozzle. Immediately ahead of the nozzle the air is directed through a number of flexible tubes which, by means of a mechanism, can be bent sideways, thereby causing the air to rotate. The rotation of the air, and hence the flame shape, can thus be varied by changing the angle of bending of the tubes, and by changing the amount of primary air. The advantage of feeding all of the primary air through only one nozzle is that it will reduce the loss of pressure and ensure a more effective mixing of air and fuel, and hence a more steady flame. However, the drawback of this type of burner is that the system with the flexible tubes requires a relatively complex regulating mechanism which also appears to be vulnerable in its intended operating environment.

SUMMARY OF THE INVENTION

The purpose of the present invention is to provide a method as well as a burner by means of which an effective mixing of fuel and air can be ensured with minimum loss of pressure, and with which the flame shape may be varied, while, simultaneously, the construction has such degree of sturdiness that a reasonable service lifetime is ensured, taking into account the high thermal and mechanical loads imposed upon the burner in the burning zone of a rotary kiln.

This is achieved by means of a method of the kind described, characterized in that the two portions of primary air are mixed at a lower velocity in a collecting duct into a single mixed primary airstream which is subsequently accelerated up to a desired, higher discharge velocity.

The invention also includes a burner for introducing solid, liquid or gaseous fuel into a burning zone of a kiln, such as a rotary kiln for manufacturing cement clinker or similar products, which burner comprises a duct or ducts for conducting the fuel and at least two annular ducts arranged substantially concentrically with, and around, the fuel duct (s) for conducting primary air, the air ducts being arranged to cause the portion of air in one of these air ducts to flow axially and the portion of air in the second air duct to flow with a rotary component about the centre axis of the burner, and means for independently controlling the amount of primary air in the portions; characterized in that the primary air ducts discharge into a joint annular collecting duct for conducting the mixed primary air to an annular nozzle, and in that the flow area of the collecting duct decreases gradually in the axial direction of movement of the air.

There is thus obtained a method as well as a burner by means of which an effective mixing of fuel and air in an operationally reliable manner can be ensured with minimum loss of pressure, and with which the flame shape can be adapted to the optimum desired. This is due to the fact that the two substreams of the primary air, prior to being injected into the kiln, are mixed at a relatively low velocity into one airstream which is subsequently, at a relatively high velocity, injected via one nozzle, the fact that the degree of rotation of the primary air can be varied by changing the interrelated amounts of the two primary airstreams, and the fact that all necessary control means can be installed in a readily accessible manner outside the burning zone of the kiln. As a result, those parts of the burner which are subjected to thermal loads can be manufactured in a simple and sturdy design. It is preferred that the flow area of the collecting duct from the location where the primary airstreams are mixed to the annular nozzle decreases by a factor of between 5 and 12 so that the velocity of the mixed primary airstream is accelerated by an equivalent factor.

In a particularly preferred embodiment of the burner according to the invention which is particularly suitable for application in a rotary kiln for manufacturing cement, it is preferred that the primary air ducts and controlling means are arranged so that the axial velocity of the flow in the primary air ducts ranges between 20 and 25 m/s, and in that the collecting duct is arranged so that the mixed primary airstream is accelerated up to a flow velocity of between 160 and 200 m/s.

The collecting duct may be configured in any practicable manner which will give an acceleration corresponding to that mentioned above. However, it is preferred that the duct is made up of two concentric annular elements, of which the outermost is configured as a frustocone which is convergent in the direction of flow with an angle of inclination α of between 30 and 60° relative to the centre axis of the burner, whereas the innermost annular element is substantially parallel to the centre axis of the burner. However, other configurations of the collecting duct are conceivable. Thus, the innermost annular element may also be configured as a frustocone which is convergent in the direction of flow. However, if this is the case, it must be formed with an angle of inclination which is considerably smaller than that of the outermost annular element.

The air in the second air duct can be made to rotate about the centre axis of the burner in different ways, inter alia by means of angularly turned tubes as previously noted. It is preferred, however, that the air is made to rotate by means of a number of oblique blades which are inserted in the second air duct immediately upstream of the discharge point of the duct.

The annular nozzle should be configured in a manner ensuring minimization of the loss of pressure. It may further consist of two concentric annular elements, at least one of which being configured as a frustocone so that the nozzle area can be varied through an axial displacement of the two elements relatively to one another.

BRIEF DESCRIPTION OF THE DRAWINGS

The invention will now be described in further detail with reference to the drawings, being diagrammatical, and wherein.

DESCRIPTION OF THE PREFERRED EMBODIMENTS

Figure 1A:
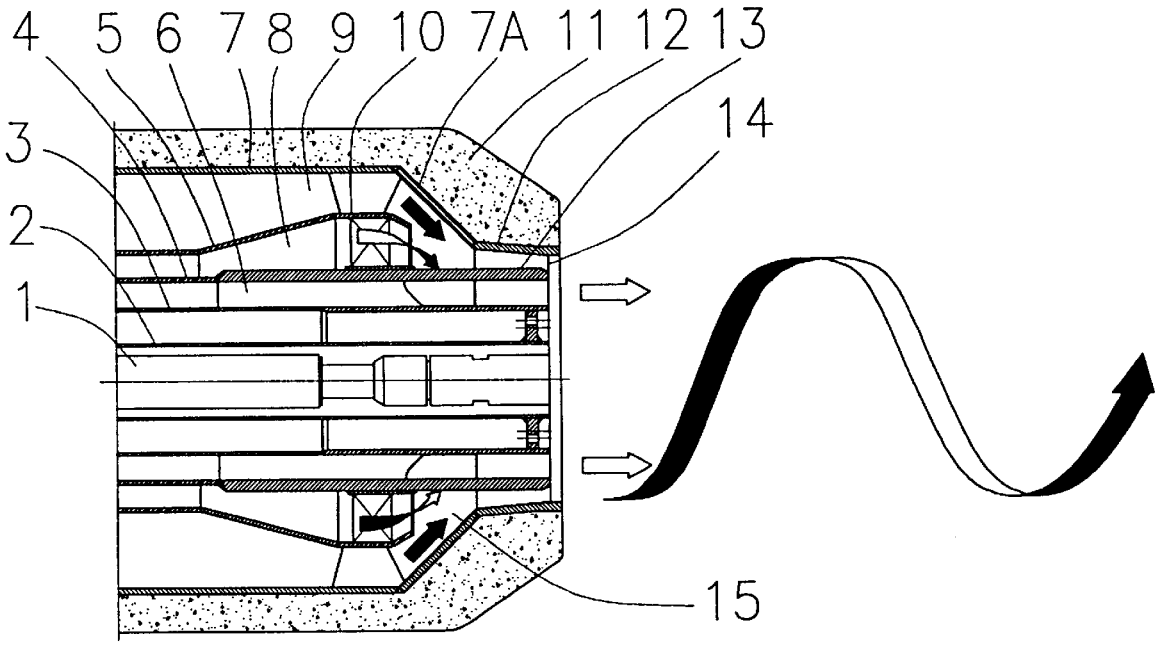
FIG. 1*a* shows a sectional view through the front section of a first embodiment of a burner according to the invention.
Figure 1B:
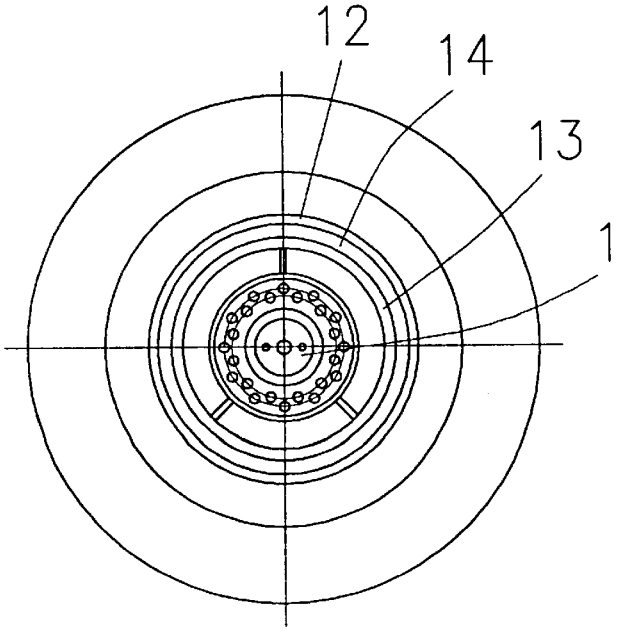
FIG. 1*b* presents a front view of the same burner.

In FIGS. 1*a* and 1*b* is shown a burner which is intended for combined firing on oil and pulverized coal, and which comprises a protective pipe 2 in which is inserted a separate lance 1 for conducting and atomizing the fuel oil.

Arranged concentrically around the protective pipe 2 are two pipes 3 and 4 which between them form an annular duct 6 for conducting and injecting a mixture of pulverized coal and air. In order to cool down the oil burner 1 and to keep it free from dust, a small amount of the total primary air can be conducted and injected into the space between the inner pipe 3 and the protective pipe 2. In addition to the protective pipe 2 it will be possible to insert one or several pipes in the inner pipe 3 for introducing supplementary alternative fuels.

Arranged concentrically around the pipes 2, 3 and 4 is an air pipe 5 which, in conjunction with the coal pipe 4, forms an annular duct 8 for conducting some of the primary air, designated rotary air. A number of oblique blades 10 are fitted in the discharge end of the duct 8 in order to subject the rotary air to a rotary motion.

Concentrically around the pipe 5 is fitted a burner pipe 7 which in conjunction with the radial air pipe 5 forms an annular duct 9 for conducting the remaining part of the primary air, designated axial air. Given that the temperature in the burning zone may be extremely high, the outside of the burner pipe 7 is provided with a ceramic refractory lining 11.

According to the invention the primary air ducts 8 and 9 discharge into a joint annular collecting duct 15. In the shown embodiment the collecting duct is provided between the pipe 4 and a cone-shaped annular element 7*a* which is connected to the burner pipe 7. In the collecting duct 15, the primary airstreams are mixed into one airstream which, because of the design of the collecting duct, is accelerated up prior to being injected into the burning zone of the kiln through an annular nozzle opening 14.

The nozzle opening 14 is provided between an outermost nozzle ring 12 which is fixed to the annular element 7*a* and an innermost nozzle ring 13 which is fixed to the coal pipe 4. By providing one or both nozzle rings 12, 13 with a conical surface, the area of the nozzle 14 may be varied through an axial displacement of the two nozzle rings relative to one another.

FIGS. 2*a*, 2*b*, 2*c* and 2*d* show different options for configuring the nozzle 14.

Figure 2A:
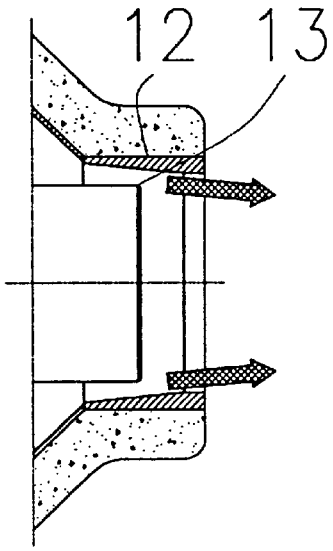
FIGS. 2*a*, 2*b*, 2*c* and 2*d* show different, alternative embodiments of a primary air nozzle with a variable area.

In FIG. 2*a* the external part 12 of the nozzle 14 is configured as a slender, convergent frustocone, whereas the internal part 12 is made as a cylinder. The direction of flow of the air is thus adjusted slightly towards the centreline of the burner.

Figure 2B:
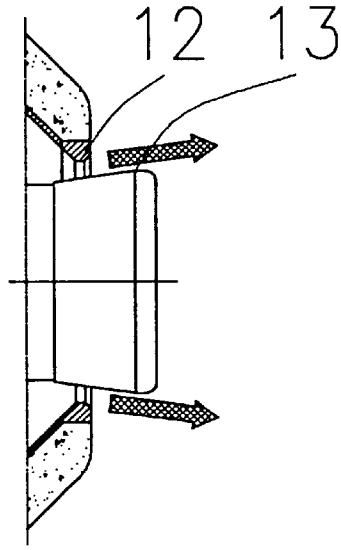

The nozzle 14 in FIG. 2*b* is formed with a smooth, circular opening where the innermost nozzle ring 13 is made with a slender, divergent frustocone which means that the direction of flow is adjusted slightly away from the centreline of the burner.

Figure 2C:
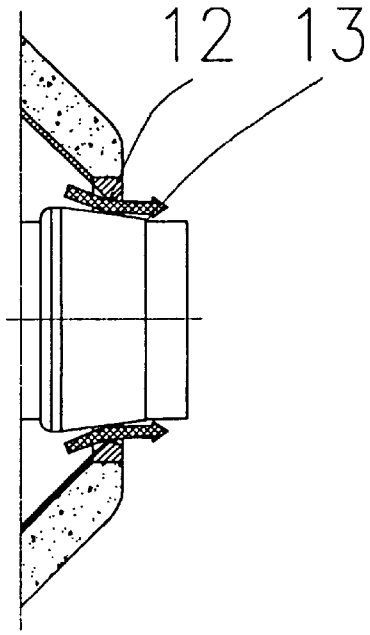
Figure 2D:
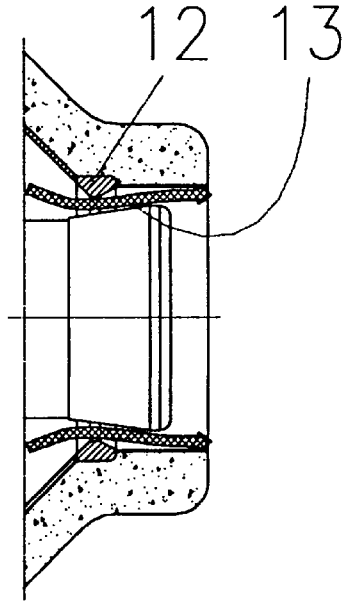

In FIGS. 2*c* and 2*d* are shown examples of nozzles 14 which are configured so that the direction of flow is axially aligned.

Figure 3A:
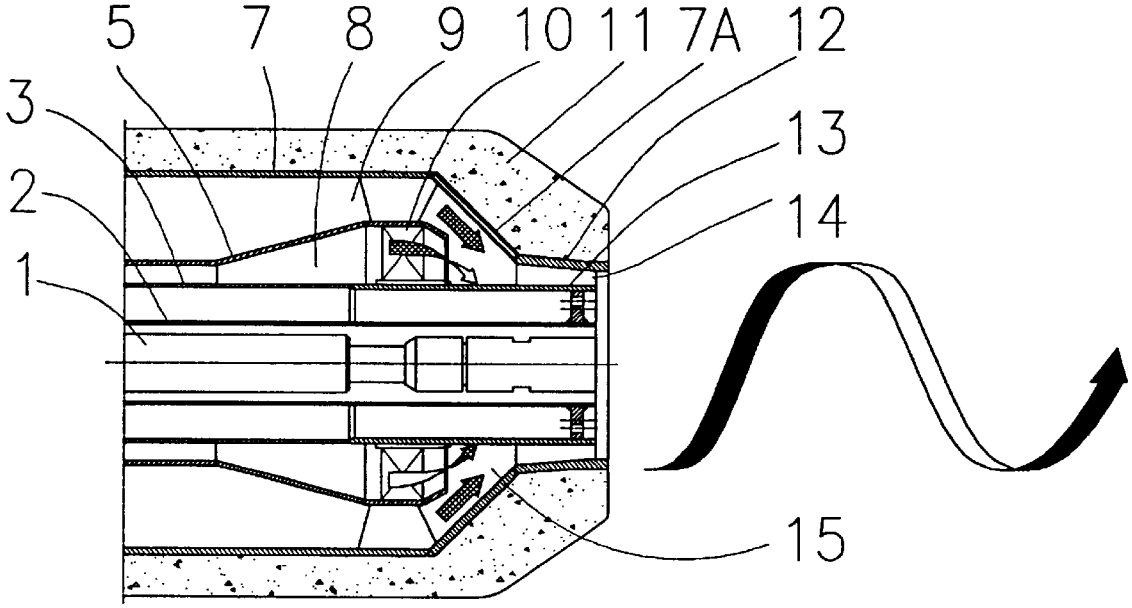
FIG. 3*a* shows a sectional view through the front section of a second embodiment of the burner according to the invention.
Figure 3B:
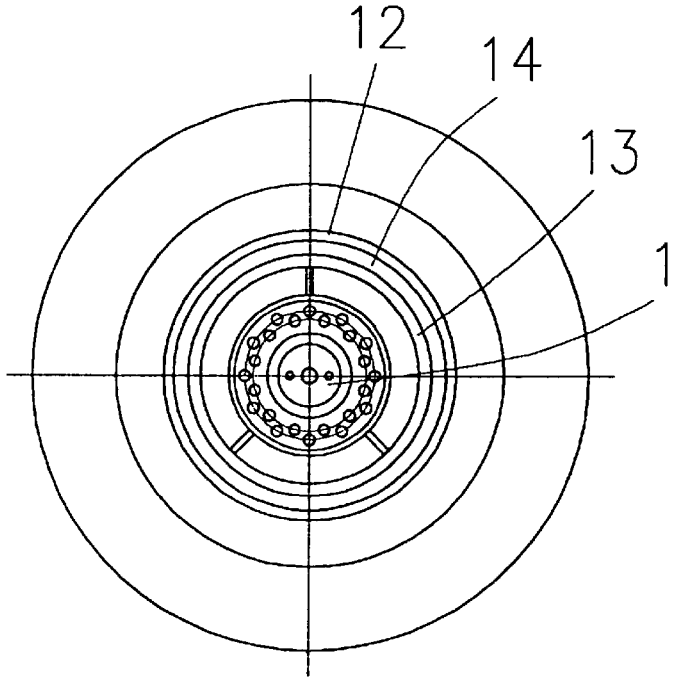
FIG. 3*b* presents a front view of the same burner.

In FIGS. 3*a* and 3*b* is shown a burner which does not incorporate a coal pipe 4. In this case, the innermost nozzle ring 13 is instead fixed to the inner pipe 3.

The operating principle of the burner shown in FIGS. 1*a* and 1*b* is that fuel oil is introduced and atomized by means of the burner lance 1. In order to cool the burner lance and to keep it clean, a small amount of the primary air is injected into the space between the inner pipe 3 and the protective pipe 2. A mixture of pulverized coal and conveying air is injected through the annular duct 6. The primary air is introduced and distributed by known methods, as described, for example, in FR-A-2348438, the disclosure of which is incorporated herein by reference, to the two primary air ducts 8 and 9. The amounts of air supplied to the two ducts 8 and 9 can be independently controlled in relation to one another. In the collecting duct 15 the two primary airstreams are mixed into one airstream. The flow characteristic of the mixed airstream is a resultant of the characteristics of the two intermingled airstreams, and comprises axial as well as rotational flow components, the interrelation of which being variable by controlling the two primary airstreams so that the optimum flame is achieved. As previously mentioned, the mixed primary airstream in the collecting duct 15 is accelerated up to a desired velocity prior to being injected into the kiln through the annular nozzle 14.

Pulverized coal and conveying air must be injected into the kiln at a velocity which is high enough to keep the coal particles suspended, but not so high as to subject the pipes to an unacceptable degree of wear exposure. Normally, the velocity will range between 25–40 m/s.

In instances where the burner is used in a conventional rotary kiln for manufacturing, for example, cement clinker, the amount of primary air being injected through the burner will typically constitute between 5 and 15 percent of the theoretically required combustion air. The remaining combustion air, typically referred to as secondary air, is introduced into the kiln without the burner being involved in this process. Quite often, heated cooling air from a subsequent material cooler is utilized as secondary air, the cooling air being typically heated to a level around 1000° C. When the burner is used for such applications, the injection velocity of the primary air should be much higher than the injection velocity of the fuel, and should normally be within the range 160 and 200 m/s. When the primary air leaves the nozzle 14 it will carry the hot ambient secondary air along, thus mixing it with the fuel. Because of the high temperature of the secondary air of around 1000° C., the fuel will be ignited.

The shape of the flame which is of paramount importance in order to ensure a steady production of cement clinker can be altered by varying the primary airflow rate and the injection velocity, and by varying the extent to which the air is subjected to rotation. Normally, a modest degree of rotation of the airflow will be required, and, therefore, the amount of primary air which is subjected to rotation when being conducted through the duct 8 typically represents between 0 and 35 percent of the total primary airflow.

What is claimed is:

1. A method for introducing solid, liquid or gaseous fuel into a burning zone of a rotary kiln, by which method fuel is conducted through and primary air is conducted through at least two annular ducts arranged substantially concentrically with, and around, the fuel duct(s), the portion of air in one of the air ducts flowing substantially axially, whereas the portion of air in the second of the air ducts comprises air which has a rotary component about the centre axis of the burner of the rotary kiln, and the amount of primary air in the two portions being independently controlled, characterized in that the two portions of primary air are mixed at a lower velocity in a collecting duct into a single primary mixed airstream which is subsequently accelerated up to a desired, higher discharge velocity.

2. A method according to claim 1 wherein the mixed primary airstream is accelerated by a factor of between 5 and 12.

3. A method according to claims 1 or 2, wherein in the axial flow velocity of the primary air in the two air ducts range between 20 and 25 m/s, and that the mixed primary airstream is accelerated up to a flow velocity of between 160 and 200 m/s.

4. A method according to any one of claims 1 or 2, wherein air in the second air duct is caused to rotate about the centre axis of the burner by being directed past a number of oblique blades immediately upstream of the discharge end of the duct.

5. A burner for introducing solid, liquid or gaseous fuel into a burning zone of a rotary kiln, which burner comprises at least one duct for conducting the fuel and at least two annular ducts arranged outside substantially concentrically with, and around, the fuel duct(s) for conducting primary air, the air ducts being arranged to cause the portion of air in one of these air ducts to flow axially and the portion of air in the second air duct to flow with a rotary component about the centre axis of the burner of the rotary kiln, and means for independently controlling the amount of primary air in the two portions; characterized in that the primary air ducts discharge into a joint annular collecting duct for conducting the mixed primary air to an annular nozzle, and in that the flow area of the collecting duct decreases gradually in the axial direction of movement of the air.

6. A burner according to claim 5, wherein the flow area of the collecting duct decreases by a factor of between 5 and 12.

7. A burner according to claim 5 or 6, wherein the primary air ducts and controlling means are arranged so that the axial velocity of the flow in the primary air ducts ranges between 20 and 25 m/s, and in that the collecting duct is arranged so that the mixed primary airstream is accelerated up to a flow velocity of between 160 and 200 m/s.

8. A burner according to claim 7, wherein the collecting duct is made up of two concentric annular elements, of which the outermost element is configured as a frustocone which is convergent in the direction of flow with an angle of inclination of between 30 and 60° relative to the centre axis of the burner.

9. A burner according to any one of claims 5 to 6, wherein the second air duct is provided immediately upstream of the discharge end of said second air duct, with a number of oblique blades for giving the portion of air in the second air duct its rotary component.

10. A burner according to any one of claims 5 to 6, wherein the nozzle is made up of two concentric annular elements, of which at least one is formed as a frustocone so that the nozzle area can be varied through an axial displacement of the two elements relative to one another.

11. A method according to claim 4, wherein air in the second air duct is caused to rotate about the centre axis of the burner by being directed past a number of oblique blades immediately upstream of the discharge end of the duct.

12. A burner according to claim 7, wherein the second air duct is provided immediately upstream of the discharge end of the duct, with a number of oblique blades for giving the portion of air in the second air duct its rotary component.

13. A burner according to claim 8, wherein the second air duct is provided immediately upstream of the discharge end of the duct, with a number of oblique blades for giving the portion of air in the second air duct its rotary component.

14. A burner according to claim 7, wherein the nozzle is made up of two concentric annular elements, of which at least one is formed as a frustocone so that the nozzle area can be varied through an axial displacement of the two elements relative to one another.

15. A burner according to claim 8, wherein the nozzle is made up of two concentric annular elements, of which at least one is formed as a frustocone so that the nozzle area can be varied through an axial displacement of the two elements relative to one another.

16. A burner according to claim 9, wherein the nozzle is made up of two concentric annular elements, of which at least one is formed as a frustocone so that the nozzle area can be varied through an axial displacement of the two elements relative to one another.

* * * * *